United States Patent [19]

Kuroda

[11] 4,354,673

[45] Oct. 19, 1982

[54] INADEQUATELY FED SHEET DETECTORS FOR USE IN SHEET-FED PRESS

[75] Inventor: Tamio Kuroda, Soka, Japan

[73] Assignee: Komori Printing Machinery Co., Ltd., Tokyo, Japan

[21] Appl. No.: 216,754

[22] Filed: Dec. 15, 1980

[30] Foreign Application Priority Data

Dec. 20, 1979 [JP] Japan ..... 54/175488[U]

[51] Int. Cl.[3] ..... B65H 7/02

[52] U.S. Cl. ..... 271/227; 271/245

[58] Field of Search ..... 271/227, 228, 243, 244, 271/245

[56] References Cited

U.S. PATENT DOCUMENTS 3,603,584 9/1971 Schmidtke ..... 271/227

3,829,702 8/1974 Eriksson ..... 271/227 X

*Primary Examiner*—Richard A. Schacher

*Attorney, Agent, or Firm*—Charles E. Pfund

[57] ABSTRACT

In an inadequately fed sheet detector of the type comprising a feed board, a transparent plate mounted on one end thereof, a swinging front guide, and a luminous element and a light receiving element respectively mounted on the feed board and the front guide on the opposite sides of the transparent plate, the luminous element is inclined with respect to the vertical.

4 Claims, 4 Drawing Figures

INADEQUATELY FED SHEET DETECTORS FOR USE IN SHEET-FED PRESS

BACKGROUND OF THE INVENTION

This invention relates to a sheet-fed press, more particularly an inadequately fed sheet detector wherein the position of a sheet (paper to be printed) stopped by a front guide or gauge is detected for preventing inadequate feeding of the sheet.

A sheet feeding apparatus utilized in a sheet-fed press is constructed such that sheets piled up on a pile table are sequentially sucked and fed into a nib between a sheet feed roller and a tape roller, then sent to a feed board by a sheet feed tape mounted on a tape roller under tension, and one ends of the sheets are caught by grippers of a swinging device to transfer the ends to grippers of a impression cylinder.

With this construction, the position of the sheet end gripped by the swing gripper at the leading end of the feed board is important. More particularly, fluctuation of this position causes deviation of the printing position on the sheet, thus forming defective printed matters and when the amount of gripping is small, the sheet drops off. Accordingly, it has been the practice to provide a front guide of the leading end of the feed board to receive and stop the leading end of the sheet, thus neatly aligning thereof and to install a sheet detector at this position so as to prevent unsatisfactory printing or breakage of the sheet caused by the overrunning thereof or prevent contamination of the impression cylinder caused by so called set off an cylinder that is when a pressure is applied across a rubber cylinder and the impression cylinder in the absence of the sheet therebetween.

For example, according to the first embodiment of Japanese Utility Model Publication No. 12509/1964, a luminous element protected by a holder is secured to the lower surface of a head board to face upward, and a light receiving element is supported by an arm on the opposite side of the head board to oppose the luminous element. A transparent acryl resin plate is provided for the head plate for transmitting light from the luminous element to the light receiving element. A front guide is mounted on one end of the feed board to be reciprocatable in the direction of feed of the sheet.

With this construction, however, while the trailing end of a first sheet fed to the impression cylinder is still in the detector, when the leading end of the next sheet reaches, the detector would misoperate by judging that two sheets are passing. Moreover, the detector detects the trailing end of the first sheet before arrival of the second sheet, whereby the detector misoperates. For this reason, in order to eliminate such misoperations it is necessary to detect only after the trailing end of the preceding sheet has left the detector. This makes it impossible to detect at an earlier time. In other words, the detector can not follow a light printing speed.

According to the second emodiment of the utility model publication referred to hereinabove, the light receiving element is supported by a holder pivotally supported by a shaft to be moved away from the detector. With this construction, since the trailing end of a preceding sheet fed to the impression cylinder is maintained above the light receiving element it becomes possible to positively detect the presence or absence of the succeeding sheet irrespective of the trailing end of the preceding sheet. For this reason, it is possible to detect more quickly than the first embodiment. This construction, however, accompanies the following problems. More particularly, where an additional printing is made on already printed portions, the position of the additional printing is caused to vary due to variation in the rotating speed of the impression cylinder or in the position of a platen for the additional printing. To improve registering or to widen the printed area, or to prevent release of the grippers, the position of the head plate is changed in the forward and backward directions so as to prevent troubles caused by adjusting the extent of gripping and feeding of the sheet.

Since the light receiving element is located just above the luminous element when the front guide is displaced somewhat in the direction of sheet feed a desired quantity of the light would be supplied from the luminous element to the light receiving element so that the detection accuracy is impaired with the result that regardless of the fact that the sheet is in a normal range the inadequately fed sheet detector produces an output or the detector does not produce an output even though the sheet lies in an abnormal range.

Another problem lies in that, according to the second embodiment, a light receiver holder must be added to the prior art mechanism, thus complicating the mechanism located between the feed board and the printing unit.

SUMMARY OF THE INVENTION

Accordingly, it is an object of this invention to provide an inadequately fed sheet detector for use in a printing machine which can accurately detect such inadequate conditions as no sheet, two sheet feeding or overrunning of the sheet while a preceding sheet still occupies the detector.

Another object of this invention is to provide an inadequately fed sheet detector especially suitable for use in a sheet-fad press.

To attain these objects, according to this invention, a front guide adapted to engage a feed board is constructed to also act as the light receiver holder shown in the second embodiment of the Japanese Utility Model Publication No. 12509/1964 and the arrangement of a light source is improved.

According to this invention, there is provided an inadequately fed sheet detector for use in a sheet-fed press comprising a feed board adapted to convey a sheet to be printed, a front guide having a sheet abutting surface for receiving and registering one end of the sheet and a sheet guide tongue extending substantially in parallel with an upper surface of the feed board to cover the sheet end, the sheet abutting surface being formed with a notch, a transparent plate mounted on one end of the feed board, and a luminous element and a light receiving element respectively mounted on the feed board and the sheet guide tongue on the opposite sides of the transparent plate, the luminous element being inclined with respect to vertical so that an area illuminated thereby takes the form of an ellipse, and the transparent plate being received by the notch so as to position a free end of the transparent plate in the illuminated area.

In a modified embodiment, the thickness of the transparent plate is made smaller than that of the feed board so as to increase the space beneath the transparent plate. With this modified construction, the luminous element can be accomodated in an inclined opening extending through the feed board, thus making compact and small the entire construction.

DESCRIPTION OF THE PREFERRED EMBODIMENTS

Figure 1:
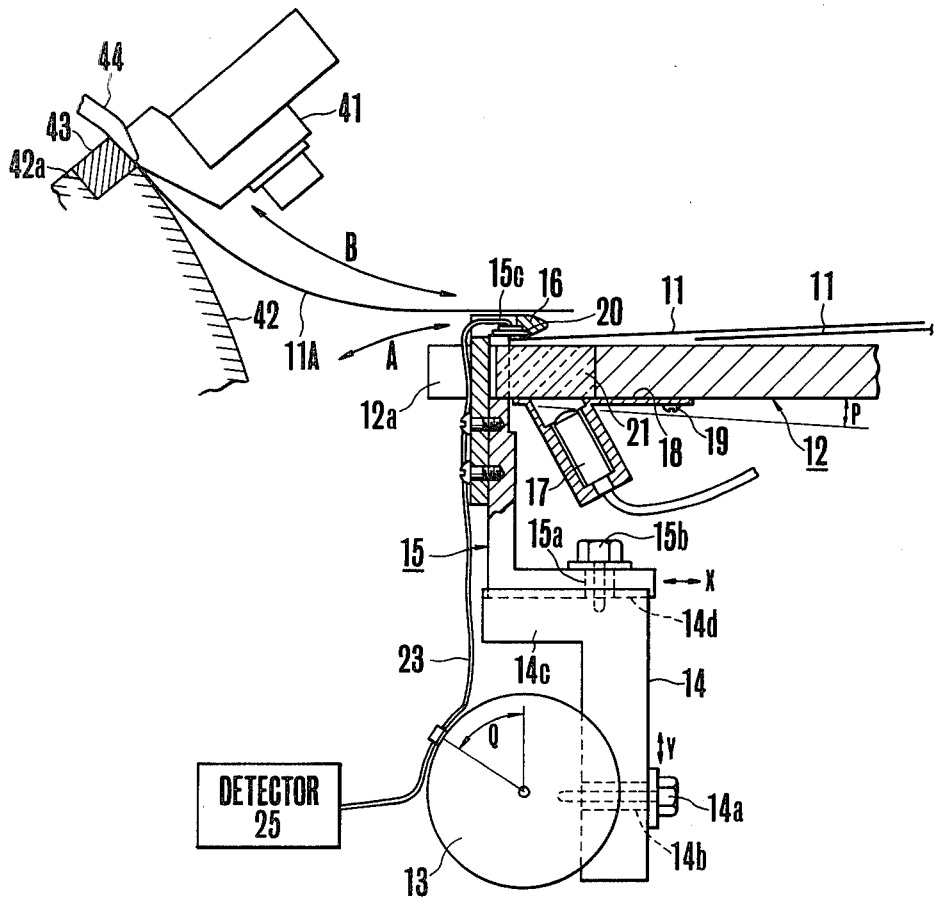
FIG. 1 is a side view, partly in section, showing one embodiment of the inadequately fed sheet detector according to this invention and suitable for use in a sheet-fed press.

In a preferred embodiment of this invention shown in FIG. 1, a feed board 12 adapted to deflect upwardly a paper sheet 11 sent from a feed roller by a sheet feed tape, not shown, the feed board 12 being inclined with respect to the vertical. Beneath the feed board 12 is journalled a front guide shaft 13 which is rotated in synchronism with an impression cylinder 42 by an angle Q during one revolution of the impression cylinder. A plurality (for example 2–6) of L shaped front guide supports 14 are juxtaposed in a direction perpendicular to the sheet of the drawing. These supports 14 are secured to the front guide shaft 13 by screws 14*a*. Each front guide support 14 is formed with an elongated slot 14*b* so that it can be adjusted in the vertical or y direction. L shaped front guide 15 is supported on the upper surface 14*c* of the supports 14 through dovetails or slots 14*d*. The front guide 15 is secured to the supports 14 by screws 15*b* extending through an elongated slots 15*a* so as to be adjustable in the horizontal direction. The upper end of the front guide 15 is received in a spaced notch 12*a* formed at the front end of the feed board 12 and is provided with upwardly projecting sheet abutting member 15*c* which is constructed to align or register the end of the received sheet 11.

Figure 3:
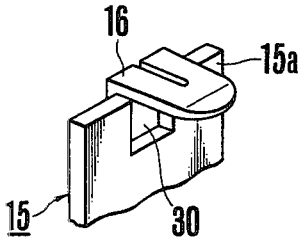
FIG. 3 is a perspective view of a portion of the front guide shown in FIGS. 1 and 2.

As best shown in FIG. 3, the front guide 15 is provided with a L shaped sheet guide tongue 16 which is secured to the front surface of the front guide 15 by screws. As shown in FIG. 1, the horizontal portion of the sheet guide tongue 16 is parallel with the upper surface of the feed board 12 to cover the end of the sheet abutting the sheet receiving surface 15*a*. The front portion is spaced from the upper surface of the feed board by a distance sufficient to receive two or three sheets. The front guide 15 swings as shown by arrow A together with the front guide shaft 13 so as to move toward and away from the sheet end.

Figure 2:
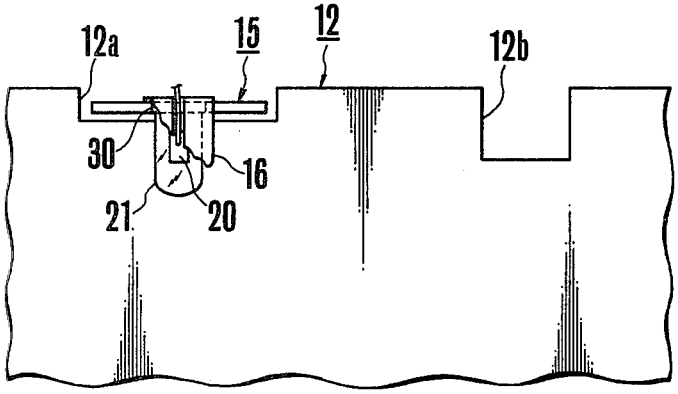
FIG. 2 is a plan view, partly cut away, of the detector shown in FIG. 1.

A cylindrical spot type (for example 10 mm) luminous (or light emitting) element 17 protected by a holder is secured to the lower front surface of the feed board 12 through a support 18 and screws 19. The luminous element 17 is inclined by about 30° so as to direct light toward the light receiving surface 15*a*. A light receiving element 20 is mounted on the sheet guide tongue 16 of the front guide 15 substantially in parallel with the feed board 12 for receiving the projected light. A light transmitting plate 21 made of transparent acryl resin is embedded in the front end of the feed board to transmit the light from the luminous element 17. By mounting the luminous element 17 at an inclined position, the light transmitting through the transparent plate takes the from of the ellipse extending over the entire length of the transparent plate 21 and having a major radius about 1.5 times of the diameter of the light spot of the luminous element. As shown in FIG. 2, the fore end of the transparent plate 21 engages a recess 30 defined by a notch formed on the upper end of the sheet abutting surface 15*c* and the inner surface of the sheet guide tongue 16 so that when the front guide 5 is moved to the foremost position, the end of the transparent plate 21 would not be brought to the outside of the illuminated range.

A swing gripper 41 is pivotally mounted to swing about a swing pivot, not shown, in a direction B to grip the sheet end near the notch 12*b* shown in FIG. 2 for feeding the sheet to the printing unit. The printing unit includes an impression cylinder 42 provided with a notch 42*a* on its periphery for receiving a gripper pad 43. There is also provided a gripper 44 which is swung about a shaft, not shown, for gripping the sheet end between the gripper 44 and the gripper pad 43.

The sheet feeder described above operates as follows. The sheet 11 fed one after one from the feed roller through the feed tape is guided by the upper surface of the feed board 12 and registered by abutting against the sheet abutting surface 15*c* of the front guide 15. Thereafter the front guide 15 is rotated in the counterclockwise direction to lease the feed board 12. Then the swing gripper 41 is brought to a position where it grips the sheet end projecting beyond the notch 12*b*. Thereafter the swing gripper 41 is swung in the opposite direction to insert the sheet end between the gripper 44 and the pad 43. A rubber cylinder with its periphery transfer printed with an image by the printing pressure applied by the impression cylinder 42 is rotating in contact with the impression cylinder 2. Before the next sheet arrives at, the front guide 15 is returned to the original position shown in FIG. 1. As above described, during the sheet feed operation there occure three types of inadequate sheet feed states, i.e., a state wherein two or more sheets are simultaneously gripped between the sheet guide tongue 16 and the feed board 12, a state wherein there is no sheet therebetween which occurs when the supply of the sheet to the feed guide is interrupted or when the sheet does not reach the sheet abutting surface, and a state wherein the shet passes beyond the sheet guide tongue 16. In the last two states, a larger quantity of light from the luminous element 17 reaches the light receiving element due to the absence of the sheet, whereas when two or more sheets are grasped the quantity of transmitting light decreases. In each case, the detector 25 operates to operate a relay or a power element through a well known amplifier and waveform shaping circuit or the like to remove the printing pressure applied by the impression cylinder 42, thus causing so called impression throw off phenamenon. Or the printing operation is interrupted due to stoppage of the front guide and of the sheet gripping operation caused by the swinging motion.

In the adequately fed sheet detecting operation, since the luminous element 17 is inclined with respect to the vertical the illuminated area takes the form of an elongated ellipse extending in the direction of sheet feeding and having a major radius larger than the diameter of the light spot of the luminous element 17 and illuminates the sheet abutting surface 15*c* over the entire area thereof. Further, since the end of the transparent plate 21 is inserted into the recess 30 of the sheet abutting surface 15*c*, even when the front guide 15 is moved to the foremost position for effecting successive printing or for adjusting the extent of gripping the force end of the transparent plate 21 still remains in the illuminated area of the luminous element 17 so that there is no fear of weakening the light. This assures stable detection accuracy together with an accurate mounting of the light receiving element 20 on the sheet guide tongue.

Moreover, this construction permits use of a luminous element having the same capacity and size as those of the prior art luminous elements. For this reason, it is possible to decrease the power consumption than a large capacity luminous element that can enlarge the light spot diameter of the luminous element.

With recent tendency of increasing the operating speed of the printing machine, the diameter of the impression cylinder 42 has been reduced for the purpose of decreasing the peripheral speed of the impression cylinder and to miniaturizing the printing machine with the result that the size of the notch 42*a* for gripping or releasing the sheet 11 has been decreased. Where the actual mechanical operation is effected by an electric signal produced by the detection of an inadequately fed sheet at the registration detector, since the operation time is constant irrespective of the mechanical rotating speed, it is necessary to produce an operating signal at an earlier time of the impression cylinder rotation with the increase in the rotating speed. For this reason, in a high speed printing machine, it is necessary to detect absence of the sheet while the trailing end of a preceding sheet is still remaining on the sheet guide tongue 16. However, according to this invention, even when the trailing end still remains on the sheet guide tongue 16, the detector operates accurately where the sheet does not present beneath the sheet guide tongue 16, so that there is no fear of misoperation as in the prior art detector thus satisfying the requirement of the high speed pringint machine.

Figure 4:
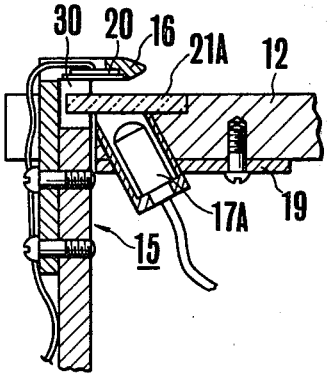
FIG. 4 is a sectional view showing a portion of a modified embodiment of this invention.

In another embodiment of this invention shown in FIG. 4, a transparent plate 21A is made thin and embedded in the upper surface of the feed board 12 and an inclined luminous element 17A is inserted in an opening extending through the feed board 12 to face the transparent plate 21A. This construction enlarges the space beneath the feed board 12 thereby increasing the selecting the shape of the front guide 15 and making more compact the entire construction. In this case, similar effect as in the embodiment shown in FIG. 1 can be realized by determining the position of the luminous element by taking into consideration the refraction of light.

As above described, in the inadequately fed sheet detecting apparatus according to this invention, since a light receiving element and a luminous element are mounted on a front guide provided with a sheet abutting surface and a sheet guide tongue and on a feed guide adapted to guide a sheet to be printed, on the opposite sides of a transparent plate at the fore end of the feed guide, such inadequately fed sheet states as no sheet, two sheet feed or overrunning state can be accurately detected while the trailing end of a preceding sheet is still remaining on the detector, thus making it possible to detect inadequate state at an earlier time which is desirable for the high speed operation. In addition, as the luminous element is inclined with respect to the vertical and the transparent plate is received in a recess of a sheet abutting surface it is possible to form an elliptical illuminated are extending over the entire length of the transparent plate, thus illuminating the entire sheet abutting surface. Moreover, as the transparent sheet does not leave the illuminated area even when the front guide is moved it is always possible to strongly illuminate the sheet abutting surface thus assuring stable detection accuracy. Moreover, since the sheet guide tongue is formed to rotate integrally with the font guide, the construction can be simplified. Further, since the luminous element is mounted on the feed board at an inclined position, wear of the luminous element caused by the movement thereof together with the front guide can be prevented. This construction also increases the space near the front guide so that the shape of the front guide can be freely determined.

What is claimed is:

1. An inadequately fed sheet detector for use in a sheet-fed press comprising:

a feed board adapted to convey a sheet to be printed;

a front guide having a sheet abutting surface for receiving and registering one end of said sheet and a sheet guide tongue extending substantially in parallel with an upper surface of said feed board to cover said sheet end;

said sheet abutting surface being formed with a notch;

a transparent plate mounted on one end of said feed board; and a luminous element and a light receiving element respectively mounted on said feed board and said sheet guide tongue on the opposite sides of said transparent plate;

said luminous element being inclined with respect to vertical so that an area illuminated thereby takes the form of an ellipse; and said transparent plate being received by said notch so as to position a free end of said transparent plate in said illuminated area.

2. The detector according to claim 1 wherein the thickness of said transparent plate is made to be smaller than that of said feed board, and said feed board is provided with an inclined through opening for receiving said luminous element.

3. The detector according to claim 1 which further comprises a hollow holder for accomodating said luminous element and means for securing said holder to the lower surface of said feed board at an inclined position with respect to the vertical.

4. The detector according to claim 1 which further comprises means for swinging said front guide and said light receiving element about a free end of said transparent plate.

* * * * *